US009527551B2

(12) United States Patent
Moving

(10) Patent No.: US 9,527,551 B2
(45) Date of Patent: Dec. 27, 2016

(54) PROPULSION SYSTEM FOR A VESSEL

(71) Applicant: CATERPILLAR PROPULSION PRODUCTION AB, Öckerö (SE)

(72) Inventor: Bjorn Moving, Nivaa (DK)

(73) Assignee: Caterpillar Propulsion Production AB, Ockero (SE)

( * ) Notice: Subject to any disclaimer, the term of this patent is extended or adjusted under 35 U.S.C. 154(b) by 0 days.

(21) Appl. No.: 14/765,300

(22) PCT Filed: Jan. 31, 2013

(86) PCT No.: PCT/IB2013/050828

§ 371 (c)(1),
(2) Date: Jul. 31, 2015

(87) PCT Pub. No.: WO2014/118595

PCT Pub. Date: Aug. 7, 2014

(65) Prior Publication Data

US 2015/0367913 A1 Dec. 24, 2015

(51) Int. Cl.

| | |
|---|---|
| ***B63H 21/17*** | (2006.01) |
| ***B63B 3/38*** | (2006.01) |
| ***B63H 20/02*** | (2006.01) |
| ***B63H 5/07*** | (2006.01) |

(52) U.S. Cl.

CPC . *B63B 3/38* (2013.01); *B63H 5/07* (2013.01); *B63H 20/02* (2013.01); *B63H 21/17* (2013.01); *B63B 2003/387* (2013.01); *Y10T 29/49819* (2015.01); *Y10T 29/49828* (2015.01); *Y10T 29/49957* (2015.01)

(58) Field of Classification Search

CPC ..... B63B 3/38; B63B 5/07; B63B 20/02; B63B 21/17

See application file for complete search history.

(56) References Cited

U.S. PATENT DOCUMENTS

| | | | |
|---|---|---|---|
| 3,565,029 | A | 2/1971 | Smit |
| 3,680,513 | A | 8/1972 | Klasic |
| 3,822,661 | A | 7/1974 | Simpson |
| 4,550,673 | A | 11/1985 | Ingvason |
| 5,103,752 | A | 4/1992 | Himeda |

(Continued)

FOREIGN PATENT DOCUMENTS

| | | |
|---|---|---|
| EP | 1 276 665 B1 | 6/2005 |
| JP | 2005524576 | 8/2005 |

(Continued)

OTHER PUBLICATIONS

International Search Report mailed Oct. 17, 2013 from Application No. PCT/IB2013/050828.

*Primary Examiner* — Stephen Avila

(57) ABSTRACT

The present invention provides a propulsion system for a vessel such as a service vessel or supply vessel. The vessel has a hull with a midship portion and a stern portion. The propulsion system comprises two propulsion units fixedly mounted to the hull on opposite sides of a centre line of the hull at the stern portion, each of the propulsion units comprising a housing carrying a propeller externally of the housing. The housing further defines an interior volume in which a drive machinery is provided for driving the propeller via a propeller shaft, the interior volume being open to the interior of the hull. A vessel comprising the propulsion system and a method of retrofitting a hull with the propulsion system are also provided.

15 Claims, 7 Drawing Sheets

(56) References Cited

U.S. PATENT DOCUMENTS

| | | | |
|---|---|---|---|
| 5,218,917 | A | 6/1993 | Harjula et al. |
| 6,062,925 | A | 5/2000 | Salmi et al. |
| 2008/0070455 | A1 | 3/2008 | Chen |

FOREIGN PATENT DOCUMENTS

| | | | |
|---|---|---|---|
| JP | 2010532290 | | 10/2010 |
| JP | 2011168238 | | 9/2011 |
| SE | 507 697 | C2 | 7/1998 |
| WO | 2006/048460 | A1 | 3/2006 |
| WO | 2010022954 | A2 | 3/2010 |
| WO | 2012/089917 | A2 | 7/2012 |
| WO | 2012/148282 | A1 | 11/2012 |

PROPULSION SYSTEM FOR A VESSEL

CROSS-REFERENCE TO RELATED APPLICATIONS

This application is a National Stage of International Patent Application No. PCT/IB2013/050828, filed Jan. 31, 2013 the content of which is incorporated herein by reference in its entirety.

TECHNICAL FIELD

The present invention relates to a propulsion system for a vessel, the propulsion system comprising two propulsion units mounted to the vessel's hull.

BACKGROUND

In typical conventional propulsion systems a prime mover, for example a main engine, inside a vessel's hull provides power, either directly or by driving a generator supplying electrical power to an electric motor, to a propeller shaft extending from the inside of the hull, through the hull, to a propeller mounted on the shaft outside the hull. This type of propulsion is reliable. However the prime mover and propeller shaft require a substantial amount of space within the vessel's hull and thus diminish the cargo capacity of the vessel. Further, the propeller shaft, which needs to be fairly long in order to extend from the inside of the hull to the outside of the hull, must be supported by several bearings, which increases the cost and maintenance requirements of this type of propulsion system. Due to the space required, this propulsion system is very difficult to retrofit to a hull.

An alternative propulsion system, which is commonly used in the offshore industry for supply vessels and service vessels, is the azimuth thrusters propulsion system. In this system an azimuthing pod bearing a propeller is rotatably mounted to the hull, thus allowing the pod, and thereby the direction of the thrust provided by the propeller, to be controlled for both propelling and steering the vessel. Typically, the propeller on the pod is driven via an angle gear by an electric motor in the stern of the hull above the pod. Alternatively, the electric motor may be provided directly in the pod. Electric power to the electric motor is supplied by a generator driven by a prime mover, for example a diesel engine.

This type of propulsion makes the vessel very manoeuvrable and obviates the need for a rudder and a lateral thruster in the stern. Furthermore, it does not diminish cargo space, since all components are mounted in the stern. However, the system is vulnerable due to mechanical complexity. Also vessels operating in ice observe problems, unless the thrusters are very much designed for this special purpose only. In case of breakdown or major maintenance, docking of the vessel is often required because many of the components of the propulsion system, for example the angle gear and sealings, are in fact not accessible for repair or service while at sea. This is a problem in the offshore industry where supply vessels and service vessels are very costly to take out of service outside the normal docking. Moreover, the increasing exploration in arctic areas calls for more heavy-duty systems that can withstand ice floes as well as perform ice breaking.

CITATION LIST

Patent Literature

Patent literature describing propulsion systems of the types mentioned above includes WO2012089917, U.S. Pat. No. 3,565,029, U.S. Pat. No. 3,680,513, WO2010022954, U.S. Pat. No. 6,062,925, EP1276665, SE507697, and WO2012148282.

SUMMARY OF INVENTION

In light of the above, it is an object of the present invention to provide a propulsion system which overcomes at least one of the disadvantages of the propulsion systems described above.

It is thus an object of the present invention to provide a propulsion system which is simple, reliable and compact.

It is a further object of the present invention to provide a propulsion system which is easy to service.

It is a further object of the present invention to provide a propulsion system which may be easily retrofitted to a vessel hull.

It is a further object of the present invention to provide a method for retrofitting a hull with the propulsion system according to the present invention.

It is yet a further object of the present invention to provide a vessel comprising the propulsion system according to the present invention.

At least one of the above objects, or at least one of further objects, which will be evident from the below description, is according to a first aspect of the present invention achieved by the propulsion system for a vessel according to claim 1.

By providing the drive machinery within the interior volume in the housing, a short propeller shaft, needing fewer bearings, for example only one bearing, may be used. This makes the propulsion system simple and reliable. Further, there is no need for an angle gear. This also makes the propulsion system simple and reliable. Further it increases the efficiency of the propulsion system and saves fuel.

Furthermore, the drive machinery does not take up cargo space, the propulsion system thus being compact.

As the interior volume is open to the interior of said hull, an operator may service the drive machinery. This makes the propulsion system easy to service.

As the housing carries the propeller, and the drive machinery is provided within the interior volume in the housing, the propulsion system is easier to retrofit as it does not require space in the cargo space of the hull.

By having the propulsion units fixedly mounted to the hull, there is no need for the expensive and complicated bearings and seals employed by conventional azimuth thruster propulsion system. This makes the propulsion system simple and reliable and reduces cost of the propulsion system. It further provides for accessing the interior of the propulsion system in a simpler way when compared with the conventional azimuth thruster propulsion system.

The vessel is preferably a service vessel or supply vessel for the offshore industry, as these types of vessels require a large cargo capacity in relation to the overall dimensions of the vessel and often operate under very harsh conditions including ice conditions where breakdowns resulting in unscheduled docking must be avoided. The vessel typically has a length from 50 to 120 m, but the vessel can be longer. Preferably the vessel is from 75 to 90 m long. The vessel typically has a deadweight of 1000 to 6000 tons, although much higher deadweights are possible.

The hull may be a single layer hull or a double hull and may be made of steel, aluminum or plastic and carbon and/or glass fibre composites.

The midship portion is the centre portion of the hull and typically has a flat bottom surface and vertical sides. The stern portion is the portion of the hull that is to the stern, i.e.

to the rear, of the midship portion. Typically the stern portion has a draft that decreases towards the stern so as to provide space for propellers and rudders. The stern portion may for example comprise a sloping planar surface, however, typically the stern portion, when viewed from the stern, has also a V-shape.

By fixedly mounted is to be understood that the propulsion units are non-rotatable, i.e. they cannot be rotated in relation to the hull in contrast to the earlier described conventional azimuth thruster propulsion system in which the pods are rotatable for directing the thrust from the propellers.

The propulsion units may be fixedly mounted to the hull by welding, by riveting, or by nuts and bolts. Further, it is contemplated within the context of the present invention that the propulsion units may be formed integral with the hull.

The propulsion units are typically placed such that the propellers are positioned close to the stern, i.e. the very end of the hull. However, the propulsion units should be placed such that there is sufficient space for a rudder behind the propeller.

The housing may be made from steel, aluminum or plastic and carbon and/or glass fibre composites.

The propeller is preferably a variable pitch propeller.

The interior volume is defined by the inside of the housing and should be sufficiently large to at least accommodate the drive machinery, while not so large as to cause unnecessary drag in the water.

The drive machinery is preferably mounted inside the interior volume, yet it is possible for a minor part of the drive machinery to extend into the hull. The propeller shaft extends from inside the housing to outside the housing.

By being open to the interior of the hull is meant that the interior volume of the housing is in communication with at least part of the interior of the hull. This may be achieved by providing an aperture in the hull above each propulsion unit and having a corresponding aperture or open end in the housing of the propulsion unit.

A preferred embodiment of the first aspect of the present invention is defined in dependent claim 2. This is advantageous because an electric motor is compact and only requires electricity to run. Furthermore, an electric motor is easily controllable.

Preferably the drive machinery includes a gear. This is advantageous because it allows the electric motor to drive a large propeller at a low rpm, leading to increased efficiency.

The electric motor typically has an effect of 500 to 5000 kW, although a much higher effect is possible.

The propeller shaft may be coupled to the gear or directly to the electric motor by a coupling for easy draw out of the propeller shaft for service.

The electric motor may be coupled to the gear via a coupling.

A preferred embodiment of the first aspect of the present invention is defined in dependent claim 3. This is advantageous as it reduces the number of bearings needed for supporting the propeller shaft and even makes it possible to use a single bearing per propeller shaft, thus making the propulsion system easier to maintain and less expensive.

By the length of the propulsion unit is meant the length along the centre line of the hull, i.e. the longitudinal length. Preferably the drive machinery is mounted in the front or bow part of the housing, i.e. the interior volume, and the propeller shaft extends from about the middle of the housing rearwards out of the stern part of the housing to the propeller.

A preferred embodiment of the first aspect of the present invention is defined in dependent claim 4. This is advantageous as it allows the drive machinery to be comfortably and efficiently serviced and maintained by the operator while the vessel is at sea, thus obviating the need for docking the vessel for performing service and maintenance.

The term accommodate is to be understood as also comprising the terms housing, containing, and providing sufficient space for. Preferably the interior volume is further adapted so that it additionally provides sufficient space for disassembling the drive machinery in case of breakdown.

The operator may be a technician or other crew of the vessel.

A preferred embodiment of the first aspect of the present invention is defined in dependent claim 5. This is advantageous because the closed bottom portion may serve to support the vessel when it is docked. Further, the open upper end is easily mounted, by for example welding the upper edge to the hull. The term fluidly connected is to be understood as meaning that the air and other fluids may pass into interior volume through the open upper end. Preferably, the open upper end is of sufficient size to allow an operator to pass through the open upper end into the interior volume. More preferably, the open upper end is also of sufficient size to allow dismounting of components of the drive machinery, such as gear, electric motor, couplings, etc.

By the preferred embodiment of the first aspect of the present invention as defined in dependent claim 6, an effective way of ensuring a uniform water flow to the propeller is provided. Generally, as the propellers on the propulsion units operate close to the hull, due to the propulsion units being mounted to the hull, there is a risk that the water flow to the propellers is not uniform due to the difference in available water close to the hull, and further down. Also the midship portion, which has the largest draft and therefore displaces water flowing along the hull, can cause disturbances and non-uniform supply of water to the propellers. As the leading edge is configured such that the distance from any part of the leading edge to the centre line is larger than the distance between the propeller shaft and the centre line, the leading edge will "catch" and divert some of the water otherwise passing on the outside of the propulsion unit and divert this water towards the centre line of the hull to increase the amount of water available to the propellers. This water is led along the inner side of the propulsion units towards the propellers. Specifically this increases the amount of water available to those propeller blades, which at a certain moment is closest to the centre line of the hull, thereby ensuring that these blades gets as much, or approximately as much, water as the blades which at that moment are farthest away from the centre line, where the amount of available water is larger due to the free water volumes beside and under the hull.

The leading edge is preferably slanted, so that the point where it is joined to the hull is closer to the bow of the hull than the point where it joins the closed bottom portion. The upper trailing edge may be parallel to the leading edge, while the lower trailing edge may be orthogonal to the leading edge. The lower trailing edge may also be curved. The upper trailing edge may be joined to the hull, and the lower trailing edge may be joined to the closed bottom portion. The propeller shaft may exit the housing at the junction between the upper and lower trailing edge.

A preferred embodiment of the first aspect of the present invention is defined in dependent claim 7. This is advantageous as a convex shape efficiently guides water while providing space for the interior volume. Preferably, the outer side is also convex, although less convex than the inner side in order to provide an interior volume suitable for housing the drive machinery.

A preferred embodiment of the first aspect of the present invention is defined in dependent claim 8. The angle α is formed by projecting the leading edges onto the plane of the bottom surface of the midship portion and extending the leading edges towards the stern of the hull, where the lines will intersect with the angle α. The angle α should be large enough to divert a sufficient amount of water, yet not too large such that too much water is diverted, leading to turbulence and increased drag. The angle α depends on the shape of the hull and the size and maximum output of the propellers.

A preferred embodiment of the first aspect of the present invention is defined in dependent claim 9. This is advantageous as it provides an increased steerability of the propulsion system according to the first aspect of the present invention. The middle skeg typically has a bottom portion which is level with the bottom surface of the midship portion and has a side portion which extends from the bottom portion to the stern portion of the hull. The middle skeg may be shaped as a wedge when seen from the side. The one or more lateral thrusters can preferably be mounted in a transverse tunnel provided in said side portion.

In an alternative embodiment of the propulsion system according to the first aspect of the present invention, the hull comprises a middle skeg as defined in claim 9, but there are no lateral thrusters in the middle skeg.

A preferred embodiment of the first aspect of the present invention is defined in dependent claim 10. This is advantageous as it ensures an effective use of the at least one lateral thruster. The propulsion units may have a length L. The first longitudinal position should be chosen such that a lateral water flow provided by the at least one lateral thruster does not hit said propulsion units having a length L and being mounted at the second longitudinal position.

In the context of the present invention, the term longitudinal refers to an axis along the hull from the bow to the stern, and the term lateral refers to an axis orthogonal to the axis along the hull from the bow to the stern.

An alternative embodiment of the first aspect of the present invention is defined in dependent claim 11. This is advantageous as it provides a more compact propulsion system which does not require a middle skeg.

A preferred embodiment of the first aspect of the present invention is defined in dependent claim 12. This is advantageous as it makes the hull easy to dock. The midship portion can have a planar bottom surface having the largest draft of the hull. The propulsion units are mounted to the stern portion, which typically has a lesser draft, yet the propulsion units can make up the difference in draft between the midship portion and the stern portion such that the propulsion units may support the hull when the vessel is docked.

In an alternative embodiment of the propulsion system according to the first aspect of the present invention, the draft of the midship portion is larger than the draft of the propulsion unit, i.e. the propulsion units are arranged so that the lower end of the housing is provided above the largest draft level of the hull. In this case, the hull should include a middle skeg as defined in claim 9, with or without one or more lateral thrusters, the middle skeg together with the midship portion supports the hull when the vessel is docked.

At least one of the above mentioned and further objects are also achieved by the vessel according to the second aspect of the present invention as defined in claim 13. The vessel, by comprising the propulsion system according to the first aspect of the present invention, is simple, reliable, and has a large cargo capacity. The vessel may be any of the vessels described above in relation to the first aspect of the present invention.

At least one of the above mentioned and further objects is moreover achieved by a third aspect of the present invention pertaining to a method of retrofitting a hull with the propulsion system according to the first aspect of the present invention as defined in claim 14.

The method is cost efficient as it does not require the provision of space in the cargo space of the vessel for bulky drive machinery and possible gear.

A preferred embodiment of the third aspect of the present invention is defined in dependent claim 15. This is advantageous as azimuth thrusters often give rise to problems when operated in harsh or icy conditions and for long service intervals, and as azimuth thrusters are easily removed from the hull.

A preferred embodiment of the third aspect of the present invention is defined in dependent claim 16. These are some suitable methods for attaching the propulsion units to the hull.

In a preferred embodiment of the third aspect of the present invention the method further comprises the step of:

optionally fitting each of said propellers on said propulsion units with a propeller nozzle.

The propeller nozzles may be attached to the hull by using welding, riveting or nuts and bolts.

BRIEF DESCRIPTION OF DRAWINGS

The invention and its many advantages will be described in more detail below with reference to the accompanying schematic drawings, which, for the purpose of illustration, show some non-limiting embodiments, and in which.

DESCRIPTION OF EMBODIMENTS

Figure 1:
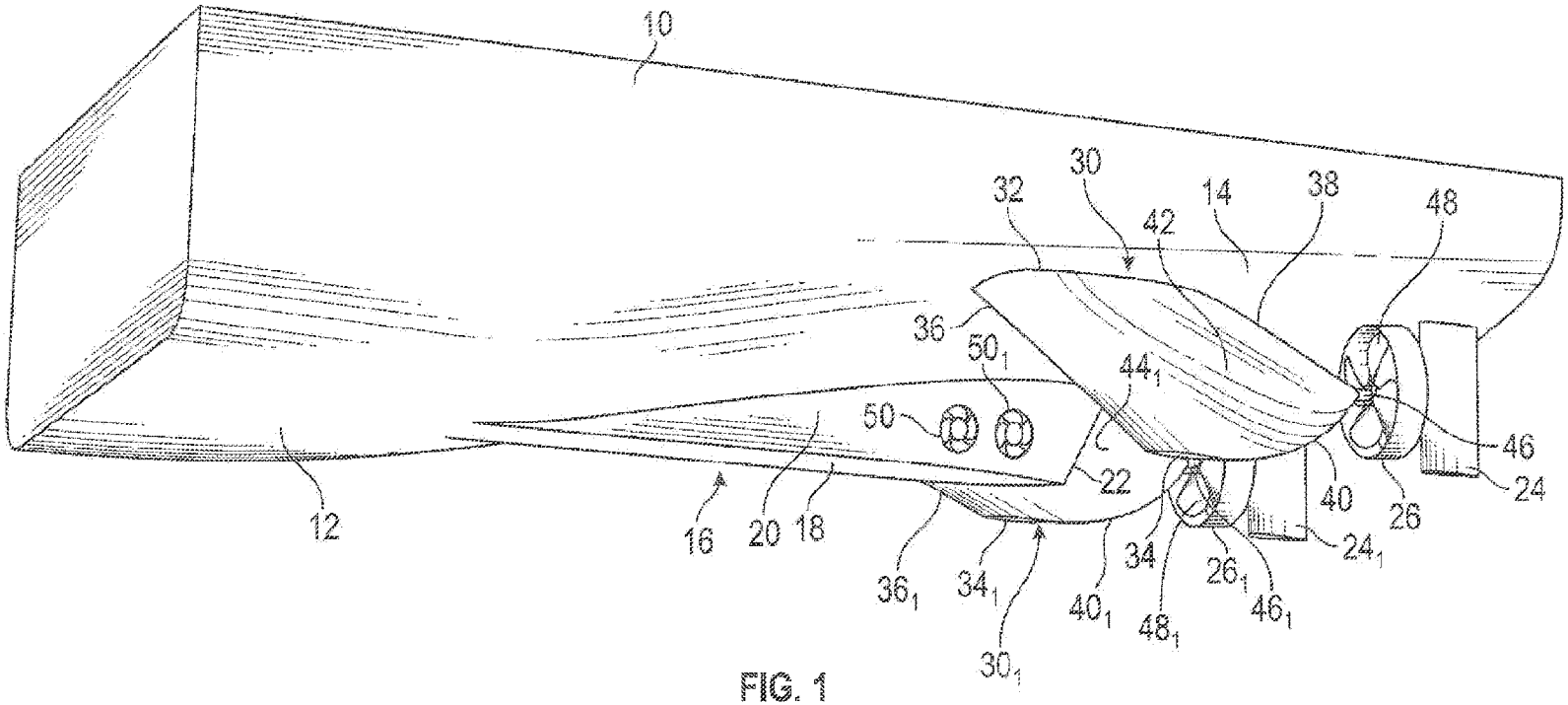
FIG. 1 shows, in perspective and partial cutaway view, a vessel's hull equipped with the preferred embodiment of a propulsion system according to the first aspect of the present invention.

In the below description, one or more subscript roman numerals added to a reference number indicates that the element referred to is a further one of the element designated the un-subscripted reference number.

Further, a superscript roman numeral added to a reference number indicates that the element referred to has the same or similar function as the element designated the un-superscripted reference number, however, differing in structure.

When further embodiments of the invention are shown in the figures, the elements which are new in relation to earlier shown embodiments have new reference numbers, while elements previously shown are referenced as stated above. Elements which are identical in the different embodiments have been given the same reference numerals and no further explanations of these elements will be given.

Figure 2:
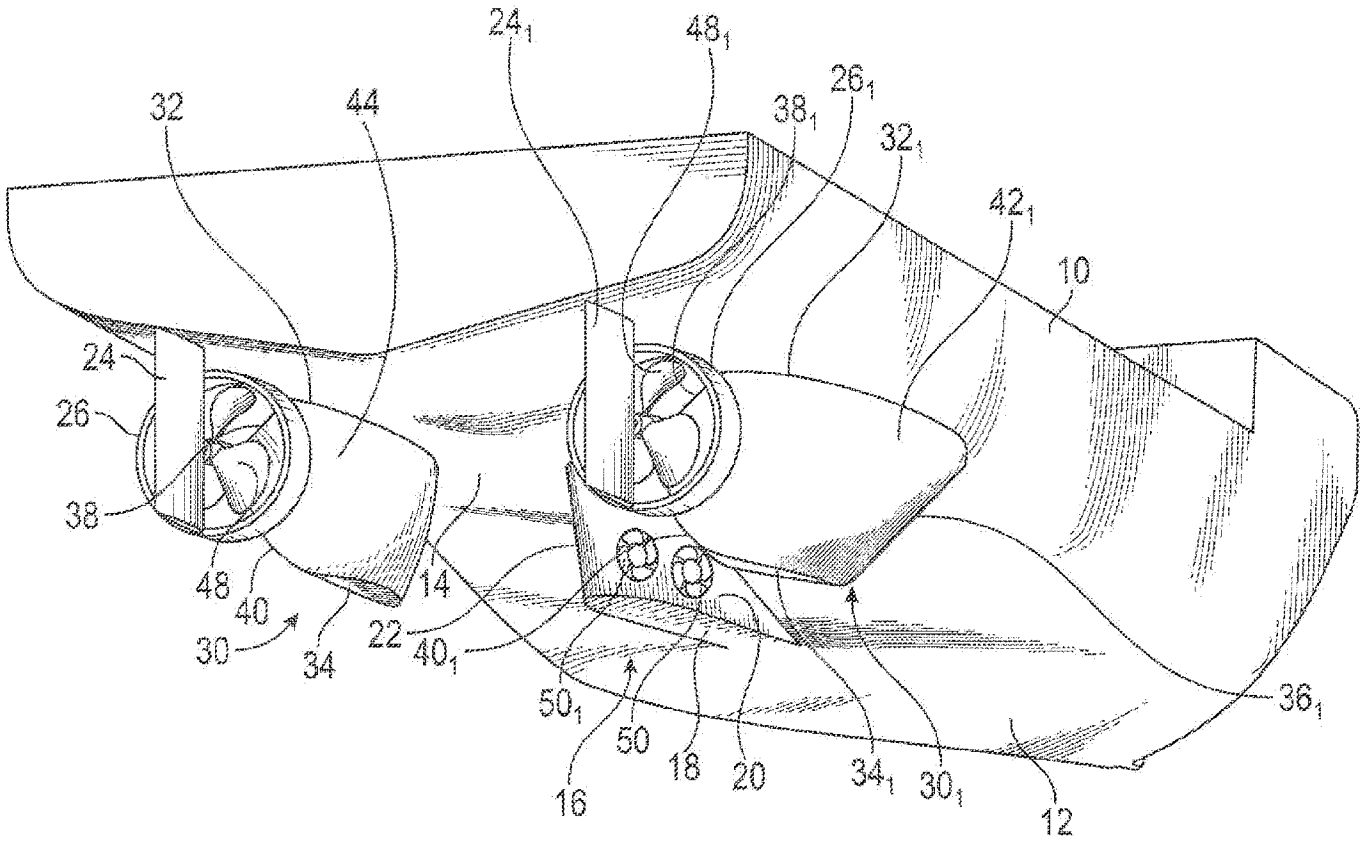
FIG. 2 shows, in different perspective view, the vessel's hull equipped with the preferred embodiment of the propulsion system according to the first aspect of the present invention.

FIGS. 1 and 2 show, in perspective and partial cutaway view, a vessel's hull 10 equipped with the preferred embodiment of a propulsion system according to the first aspect of the present invention. The hull 10 comprises a midship portion 12 and a stern portion 14. The midship portion has the largest draft and has a planar bottom surface. The stern portion comprises the hull 10 from the midship portion 12 to the stern of the hull 10 and has a draft which decreases towards the stern. A middle skeg 16 having the same draft as the midship portion 12 extends from the midship portion 12 along a part of the stern portion 14. The middle skeg 16 has a bottom portion 18, a side portion 20, and a stern edge 22.

The stern portion 14 further includes two rudders 24, each positioned aft of a corresponding propeller nozzle 26. The hull 10 further includes apertures 28, only shown in FIG. 4, which will be discussed in further detail in connection with FIG. 4.

The first embodiment of the propulsion system comprises twin propulsion units 30, which are mounted to the hull 10 in the stern portion 14 via an upper edge 32 of the propulsion unit 30. Opposite the upper edge 32 is provided a bottom portion 34 for supporting the propulsion unit 30 and the hull 10 when the hull 10 is docked. The propulsion unit 30 further comprises a leading edge 36, extending from the upper edge 32 to the bow of the bottom portion 34, and a upper trailing edge 38, which extends downwards from the upper edge 32. A lower trailing edge 40 extends from the stern part of the bottom portion 34 and meets the upper trailing edge 38 at the position where a propeller shaft 46 protrudes from the propulsion unit. The propulsion unit 30 further comprises an outer side 42, facing away from the centreline of the hull 10, and an inner side 44, facing towards the centreline of the hull 10.

The propeller shaft 46 carries a propeller 48 for applying thrust to the propulsion unit 30 and thereby propelling the hull 10.

The propulsion system according to the first aspect of the present invention preferably comprises lateral thrusters 50. These may, as shown in the figures, be provided in the middle skeg 16. Alternatively, a lateral thruster 50 may be provided in each of the propulsion units 30, $\mathbf{30_1}$.

Figure 3A:
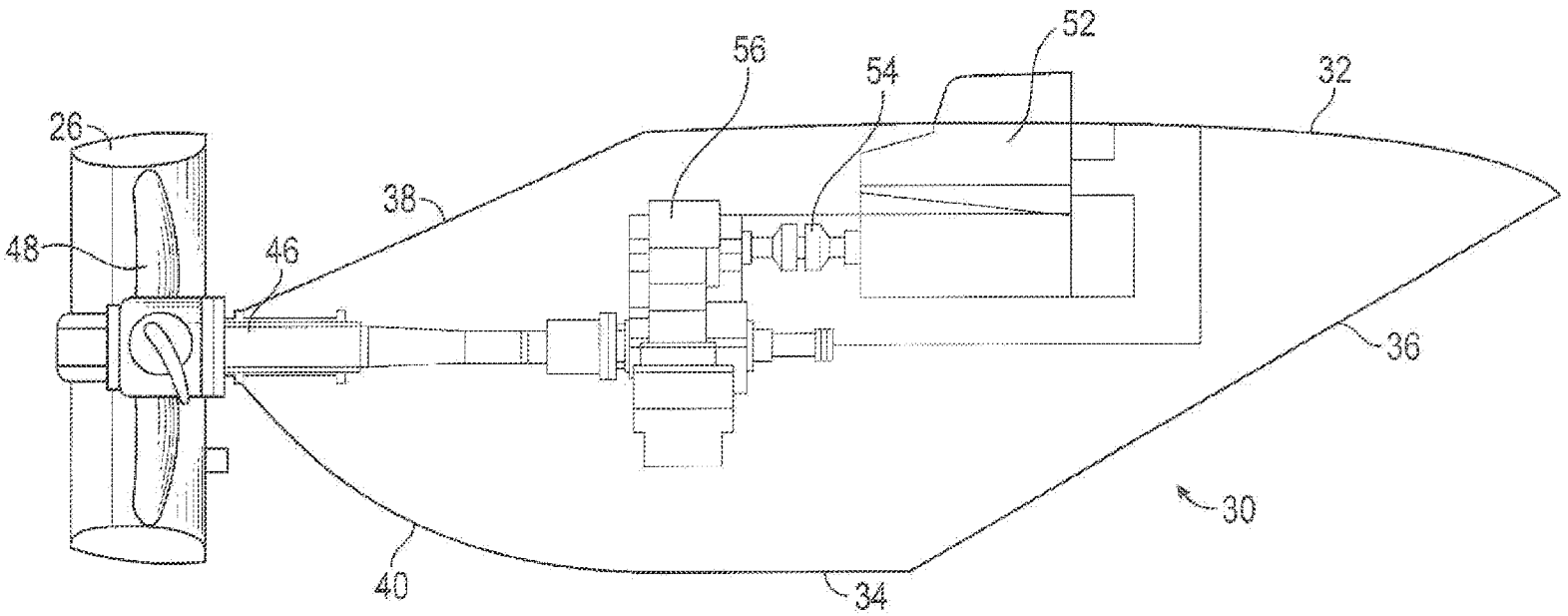
FIG. 3 shows, in side and end elevation view, a propulsion unit comprised by the preferred embodiment of the propulsion system according to the first aspect of the present invention.
Figure 3B:
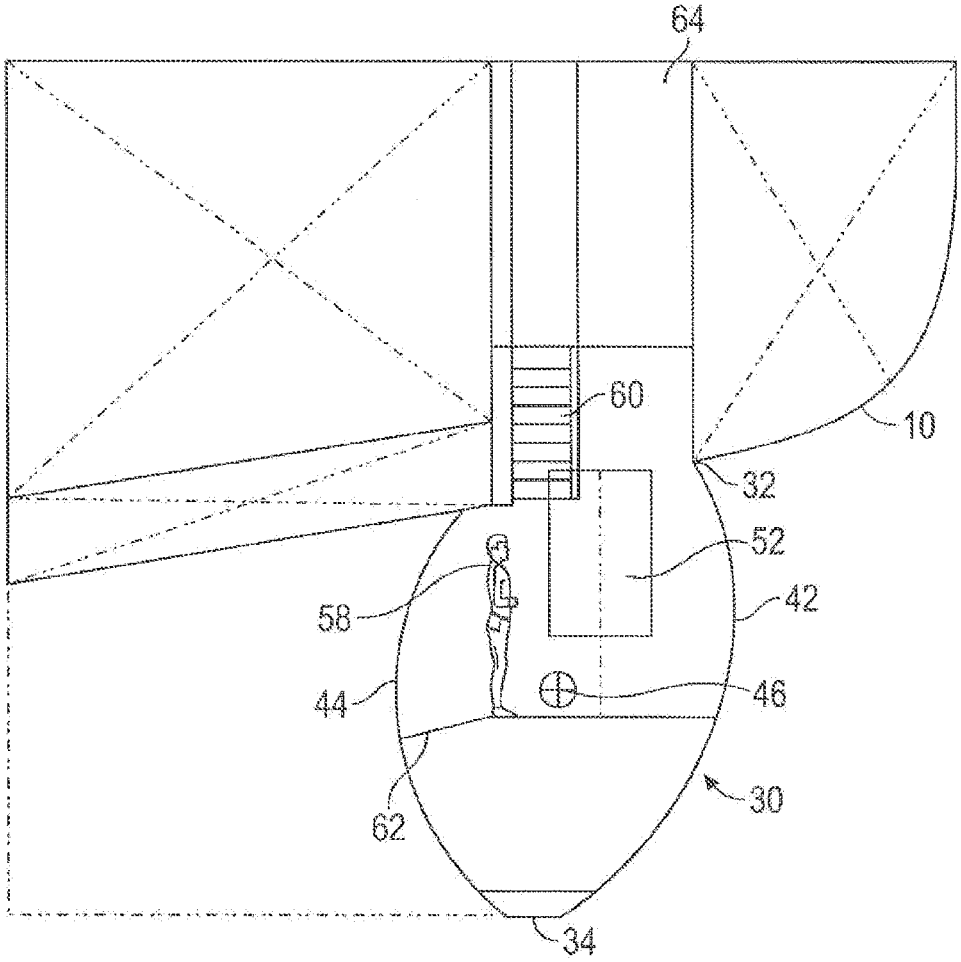

FIG. 3 shows, in FIG. 3A side elevation view, in FIG. 3B end elevation view, the propulsion unit 30 comprised by the preferred embodiment of the propulsion system according to the first aspect of the present invention. The interior of the propulsion unit 30 defines an interior volume for housing an electric motor 52, which is coupled, via a coupling 54, to a gear 56. The gear 56 is in turn connected to the propeller shaft 46. The interior volume is enterable by an operator 58 via a ladder 60. Preferably, a walking surface, such as a floor 62, is provided for allowing the operator 58 to move around in the propulsion unit 30 to service and maintain the electric motor 52, the coupling 54, the gear 56, and the propeller shaft 46.

A corridor 64 may be provided in the hull 10 and may lead to the ladder 60.

Where, as proposed above, a lateral thruster 50 is provided in the propulsion unit 30, the lateral thruster 50 is preferably positioned beneath the propeller shaft 46 between the propeller 48 and the gear 56.

Figure 4:
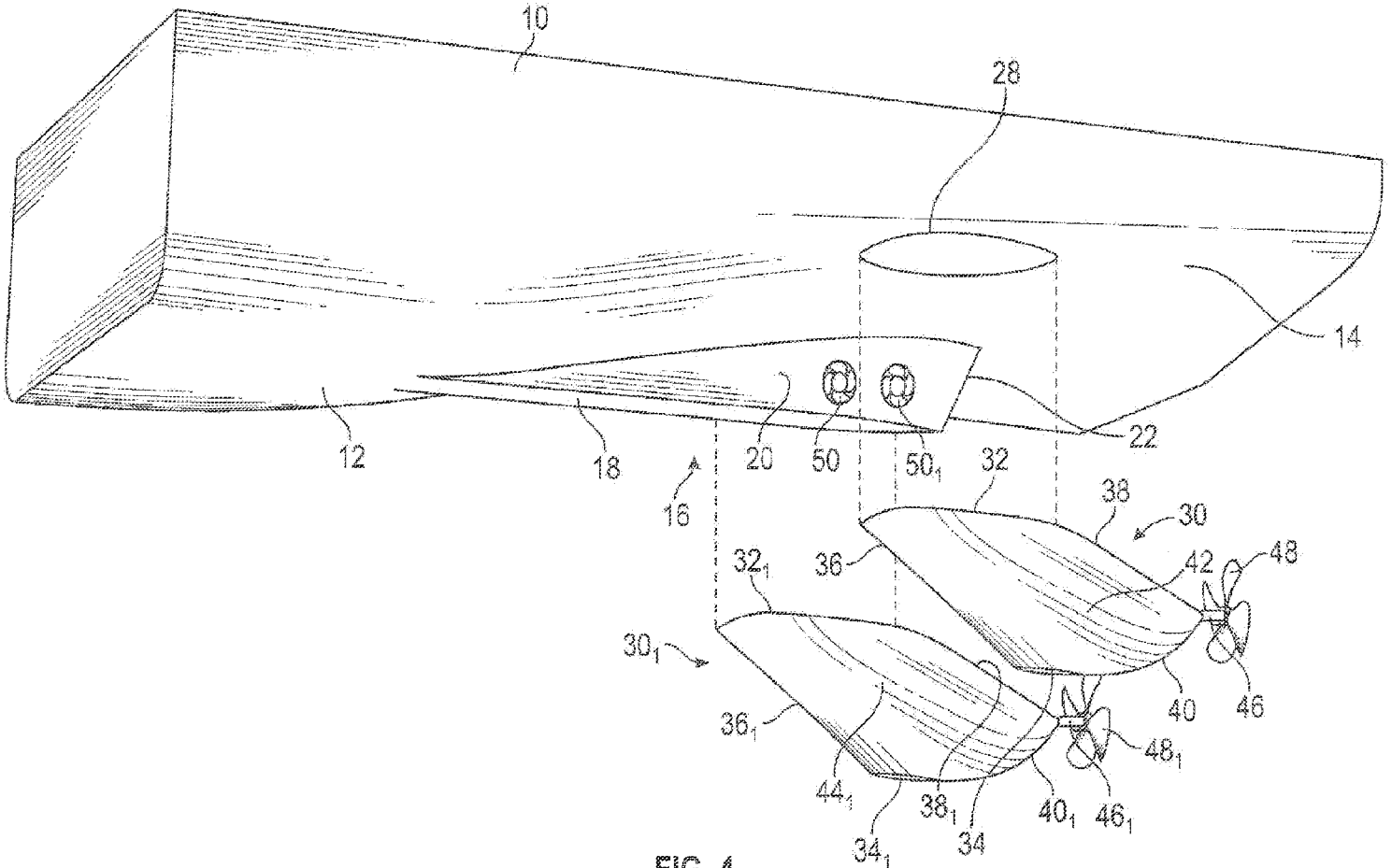
FIG. 4 shows, in exploded perspective view, the assembly of the propulsion unit comprised by the preferred embodiment of the propulsion system according to the first aspect of the present invention with a vessel's hull.

FIG. 4 shows, in exploded perspective view, the assembly of the propulsion unit 30 comprised by the preferred embodiment of the propulsion system according to the first aspect of the present invention, with the vessel's hull 10. As shown in FIG. 4, the propulsion unit 30 may be constructed separate from the hull 10 and joined to the hull 10 by for example welding. To prepare the hull 10 for the joining with the propulsion unit 30, a suitable aperture 28 is cut in the stern portion 14 of the hull 10. Alternatively, the hull 10 is designed to have the suitable aperture 28. Preferably, as shown in FIG. 4, the shape of the aperture 28 corresponds to the shape of the upper edge 32 of the propulsion unit 30. The propulsion unit 30 with the upper edge 32 is then inserted into the aperture 28 and welded to the hull 10. After joining the propulsion unit 30 to the hull 10, the propeller nozzle 26 and the rudder 24 are installed (not shown).

It is evident from studying FIG. 4 and the above description that a vessel having an azimuth thruster propulsion system can be easily retrofitted with the propulsion system according to the present invention. To do this, the one or more azimuth thrusters are first removed from the hull 10. Then the holes left by the azimuth thrusters are sealed, and suitable apertures 28 are created and the propulsion units 30 joined to the hull 10. Cables for delivering power to the electric motor 52 are then rerouted from the electric motors which powered the azimuth thrusters and easily led into the propulsion unit 30 via the aperture 28.

To increase manoeuvrability it is preferred that the middle skeg 16 with lateral thrusters 50 is then joined to the hull 10. Alternatively, lateral thrusters may be provided directly in the propulsion units 30.

The propulsion system according to the present invention is easy to retrofit to an existing hull 10 since it does not take up space in the interior of the hull 10.

Figure 5:
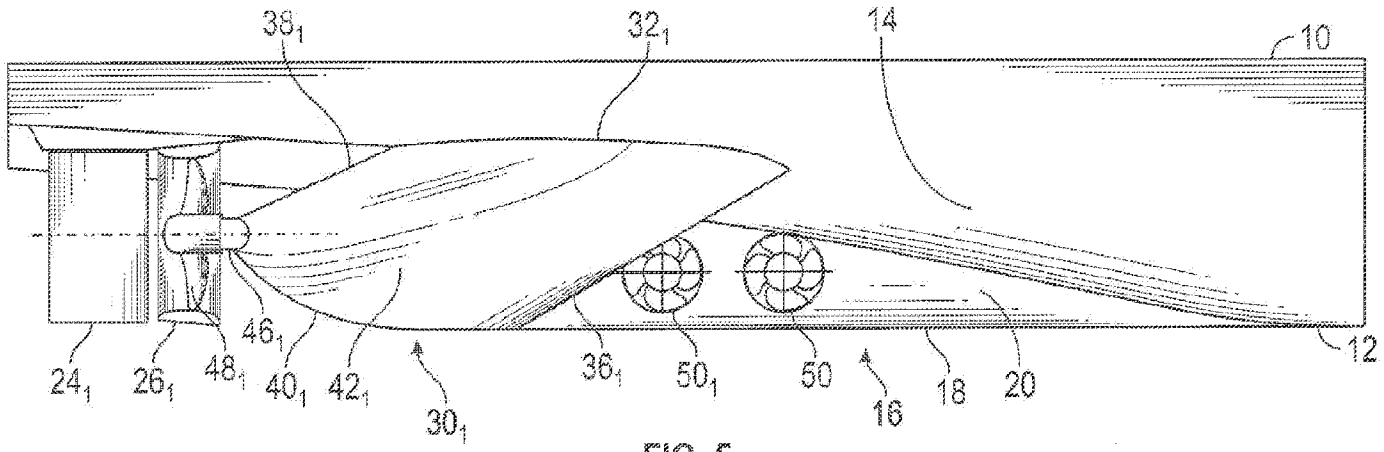
FIG. 5 shows, in side elevation view, a portion of the stern portion of the vessel's hull equipped with the preferred embodiment of the propulsion system according to the first aspect of the present invention.

FIG. 5 shows, in side elevation view, a portion of the stern portion 14 of the vessel's hull 10 equipped with the preferred embodiment of the propulsion system according to the first aspect of the present invention. As is clear from FIG. 5, the arrangement of the propulsion unit 30 and the lateral thrusters' 50 and $\mathbf{50_1}$ position in the middle skeg 16 is such that the water flow from the lateral thrusters 50 and $\mathbf{50_1}$, which water flow is transversal in relation to the longitudinal water flow of the propeller 44 on the propulsion unit 30, is mostly unimpeded by the propulsion unit 30.

Figure 6:
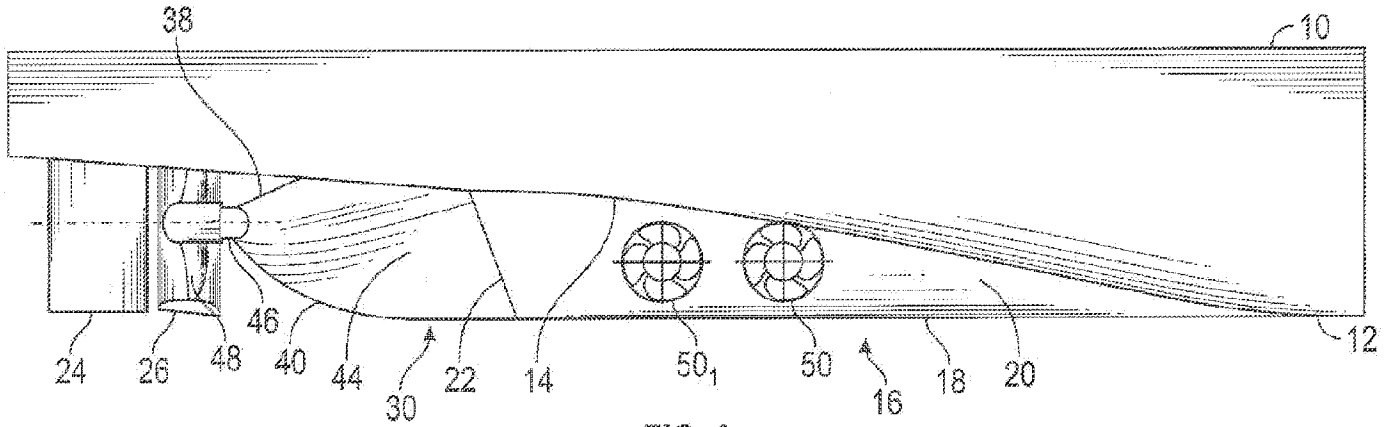
FIG. 6 shows, in section view along the centreline of the vessel's hull, a middle skeg of the vessel's hull equipped with the preferred embodiment of the propulsion system according to the first aspect of the present invention.

FIG. 6 shows, in section view along the centreline of the vessel's hull 10, the middle skeg 16 of the vessel's hull 10 equipped with the preferred embodiment of the propulsion system according to the first aspect of the present invention. As can be seen from FIG. 6, the bottom portion 18 together with the bottom of the midship portion 12 provides a longitudinally level surface for docking the hull 10. The bottom of the midship portion 12, together with the bottom portion 34 of the propulsion unit 30, provides a laterally level surface for docking the hull 10.

Figure 7:
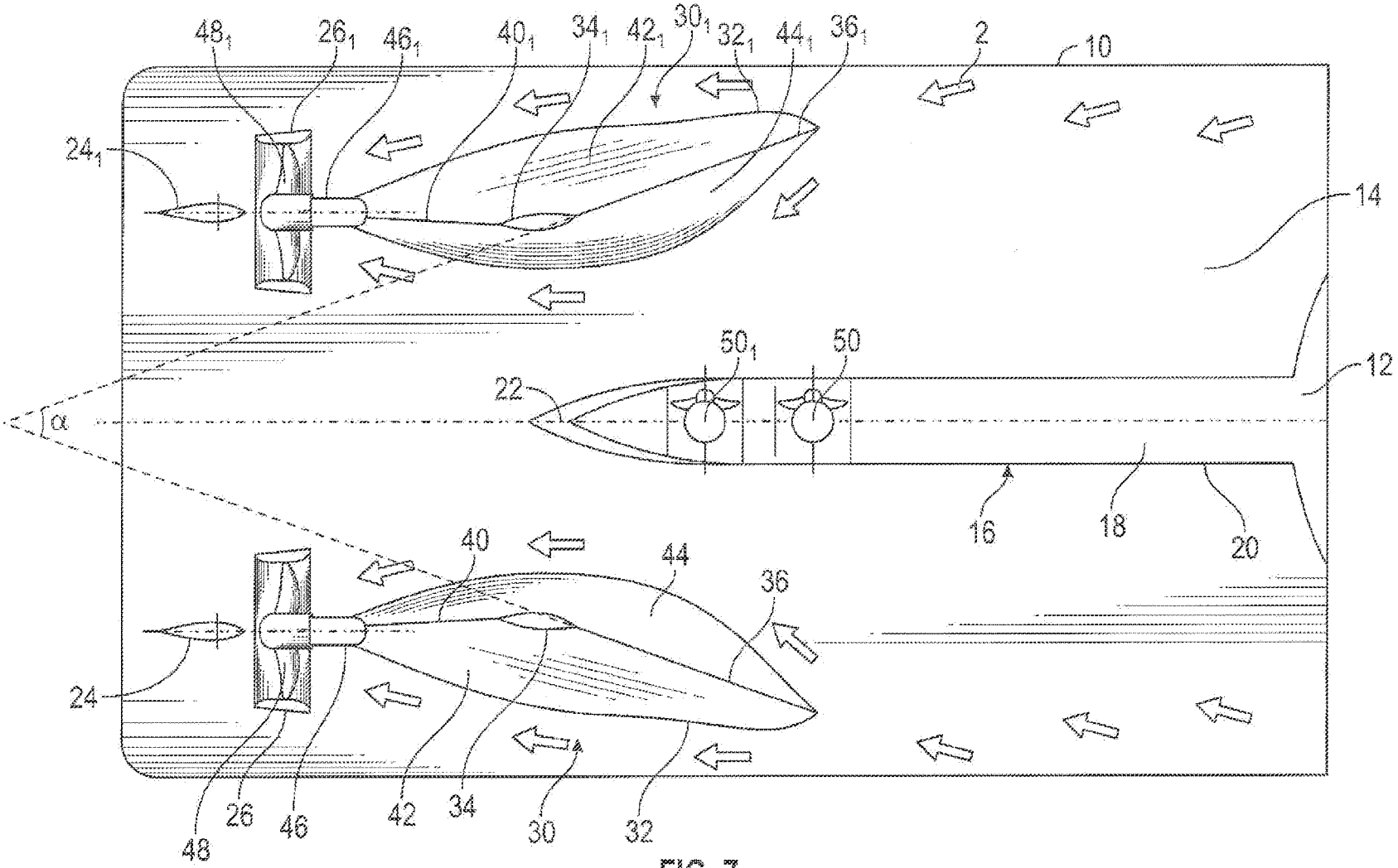
FIG. 7 shows, in plan view, the bottom of the stern portion of the vessel's hull equipped with the preferred embodiment of the propulsion system according to the first aspect of the present invention.

FIG. 7 shows, in plan view, the bottom of the stern portion 14 of the vessel's hull 10 equipped with the preferred embodiment of the propulsion system according to the first aspect of the present invention. On a hull 10 as depicted in FIGS. 1-2 and 4-7, the midship portion 12 and the middle skeg 16 may restrict, or otherwise disturb, the flow of water to those blades of the propeller 44 which at a certain moment are closest to the centre line of the hull 10. This is due to the differing drafts of the midship portion 12 and the stern portion 14. This leads to an unbalanced loading of the propeller, which may give rise to vibrations and excessive wear of the propeller shaft bearings. To counter this effect when the hull 10 is equipped with the preferred embodiment of the propulsion system according to the present invention, the inner side 44 of the propulsion unit 30 is convex, and the main part of the leading edge 36 is positioned at a lateral distance from the hull centre line, which is larger than the lateral distance between the centre of the propeller shaft 46 and the centre line. As can be seen in the figure, the leading edges 36 and $\mathbf{36}_1$ together forms an angle $\alpha$, which is about 30°. Thus, part of the water flowing along the hull 10, as illustrated by arrows, one of which is designated the reference numeral 2, is deflected towards the centre line of the hull 10 by the leading edge 36 and the inner side 44. Close to the hull 10, i.e. in the vicinity of the upper edge 32, where the disturbance of the water flow is the largest due to the presence of the hull 10 and the friction between hull 10 and the water 2, the leading edge 36 has the longest lateral distance to the centre line, resulting in the large deflection of the water 2 needed to overcome the effects of the hull 10. Closer to the bottom portion 34, where the disturbance on the water 2 is less, as the water may flow freely under the hull 10 including the midship portion 12, the lateral distance is lesser.

This ensures that the propeller 48 is provided with a uniform water flow, leading to a uniform load on the propeller 48. The outer side 42 is preferably also convex, to a lesser degree than the inner side 44, in order to direct water towards the propeller 48 and to provide a suitable interior volume.

LIST OF PARTS WITH REFERENCE TO THE FIGURES

2. Arrow illustrating water flowing along the hull.
10. Hull
12. Midship portion
14. Stern portion
16. Middle skeg
18. Bottom portion
20. Side portion
22. Stern edge
24. Rudder
26. Propeller Nozzle
28. Aperture
30. Propulsion unit
32. Upper edge
34. Bottom portion
36. Leading edge
38. Upper trailing edge
40. Lower trailing edge
42. Outer side
44. Inner side
46. Propeller shaft
48. Propeller
50. Lateral thruster
52. Electric motor
54. Coupling
56. Gear
58. Operator
60. Ladder
62. Floor
64. Corridor

The invention claimed is:

1. A propulsion system for a vessel, said vessel having a hull with a midship portion and a stern portion, said propulsion system comprising two propulsion units fixedly mounted to said hull on opposite sides of a centre line of said hull at said stern portion, each of said propulsion units comprising a housing carrying a propeller externally of said housing, said housing further defining an interior volume in which a drive machinery is provided for driving said propeller via a propeller shaft, said interior volume being open to the interior of said hull, said housing further comprising opposite inner and outer sides, said inner side facing said centre line of said hull, said inner and outer side being joined at a bow part of said propulsion unit along a leading edge, and at a stern part of said housing along an upper and lower trailing edge, and at a lower part of said propulsion unit by a closed bottom portion, said propeller shaft being provided at a first distance from said centre line of said hull, and said leading edge being configured such that the distance from any part of said leading edge to said centre line of said hull is larger than said first distance for causing part of the water flowing along said hull to be diverted by said inner side towards said centre line of said hull.

2. The propulsion system according to claim 1, said drive machinery comprising an electric motor, and a gear.

3. The propulsion system according to claim 1, said propeller shaft having a length that is less than half the length of said propulsion unit.

4. The propulsion system according to claim 1, said interior volume being adapted to accommodate an operator of said drive machinery.

5. The propulsion system according to claim 1, said housing having a closed bottom portion and an open upper end defined by an upper edge attached to said hull, said interior volume being fluidly connected to said open upper end.

6. The propulsion system according to claim 1, said inner side being convex.

7. The propulsion system according to claim 1, said leading edges forming an angle $\alpha$, which is between 5° and 90°.

8. The propulsion system according to claim 1, said hull further comprising a middle skeg mounted on said centre line of said hull and extending horizontally from said midship portion along at least part of said stern portion the propulsion system further comprising one or more lateral thrusters mounted in said middle skeg.

9. The propulsion system according to claim 8, said at least one lateral thruster being mounted at a first longitudinal position along centre line of said hull said propulsion units being mounted at a second longitudinal position along said centre line of said hull, and said first and second positions being such that a lateral water flow provided by said at least one lateral thruster does not hit said propulsion unit.

10. The propulsion system according to claim 1, each of said propulsion units further comprising a lateral thruster mounted in said housing below said propeller shaft.

11. The propulsion system according to claim 1, the draft of said midship portion being equal to the draft of said propulsion units such that said propulsion units together with said midship portion support said hull when said vessel is docked.

12. A vessel comprising the hull and the propulsion system according to claim 1.

13. A method of retrofitting a hull with the propulsion system according to claim 1, said hull having a midship portion and a stern portion, comprising the steps of:

providing said hull, providing a propulsion system according to claim 1, providing two apertures in said stern portion, and attaching each of said propulsion units to a corresponding one of said apertures.

14. The method according to claim 13, said conventional drive machinery comprising azimuth thrusters.

15. The method according to claim 13, said attaching comprising welding or riveting.

* * * * *